US008770870B2

(12) United States Patent
Otoshi

(10) Patent No.: US 8,770,870 B2
(45) Date of Patent: Jul. 8, 2014

(54) PRINTER WITH RIBBON MARKER DETECTION CONTROL

(75) Inventor: Tatsuya Otoshi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 338 days.

(21) Appl. No.: 13/191,159

(22) Filed: Jul. 26, 2011

(65) Prior Publication Data

US 2012/0027488 A1 Feb. 2, 2012

(30) Foreign Application Priority Data

Jul. 30, 2010 (JP) ..... 2010-172290

(51) Int. Cl.

| | |
|---|---|
| ***B41J 17/12*** | (2006.01) |
| ***B41J 17/10*** | (2006.01) |
| ***B41J 17/08*** | (2006.01) |
| ***B41J 33/54*** | (2006.01) |

(52) U.S. Cl.

CPC *B41J 17/12* (2013.01); *B41J 17/10* (2013.01); *B41J 17/08* (2013.01); *B41J 33/54* (2013.01)

USPC ..... 400/76; 400/223; 400/240; 400/240.4

(58) Field of Classification Search

CPC ..... B41J 17/08; B41J 17/10; B41J 17/12; B41J 33/54

USPC ..... 400/240, 240.4, 223, 236

See application file for complete search history.

(56) References Cited

U.S. PATENT DOCUMENTS

| | | | | |
|---|---|---|---|---|
| 4,496,955 | A | 1/1985 | Maeyama et al. | |
| 4,577,199 | A * | 3/1986 | Saiki et al. | 347/215 |
| 5,144,331 | A * | 9/1992 | Amano | 347/178 |
| 6,010,259 | A * | 1/2000 | Hadley | 400/240.3 |
| 2007/0041768 | A1 * | 2/2007 | Kawada | 400/240 |

FOREIGN PATENT DOCUMENTS

| | | | | |
|---|---|---|---|---|
| JP | 09039331 | A * | 2/1997 | B41J 2/325 |
| JP | 2000218892 | A * | 8/2000 | B41J 2/325 |
| JP | 2006-159432 | A | 6/2006 | |
| JP | P4455299 | B2 | 4/2010 | |

* cited by examiner

*Primary Examiner* — Daniel J Colilla

(74) *Attorney, Agent, or Firm* — Canon U.S.A., Inc. IP Division

(57) ABSTRACT

A printer performs printing by transferring ink of an ink ribbon on which a plurality of color inks is sequentially arranged to paper, and the printer includes a paper conveyance unit configured to convey paper, an ink ribbon conveyance unit configured to be driven by the same drive source as that of the paper conveyance unit and convey the ink ribbon only in a printing direction, and a detection unit configured to detect a marker for detecting the top of color inks provided on the ink ribbon, wherein a marker of a specific color ink of the ink ribbon includes marker pieces, the number of which is greater than that of the other markers.

13 Claims, 10 Drawing Sheets

PRIOR ART

PRINTER WITH RIBBON MARKER DETECTION CONTROL

BACKGROUND OF THE INVENTION

1. Field of the Invention

The present invention relates to a printer for printing on paper using an ink ribbon.

2. Description of the Related Art

As a printer for printing photos captured by a digital camera or the like, a thermal printer is known which sublimates ink ribbon by a thermal head and performs thermal transfer printing on a recording paper. When forming a color image by a thermal printer, a three-color ink ribbon of yellow, magenta, and cyan is used, and one image is formed by three thermal transfer processes.

As discussed in Japanese Patent Application Laid-Open No. 2006-159432, a method is known in which three thermal transfers of yellow, magenta, and cyan are performed by one thermal head to reduce size and cost of the printer. In this case, an ink ribbon is used in which a set of dye portions of yellow, magenta, and cyan is repeatedly arranged to form dye surfaces, the number of which corresponds to the number of print pages.

FIG. 2 illustrates an ink ribbon used by the thermal transfer printer discussed in Japanese Patent Application Laid-Open No. 2006-159432.

As illustrated in FIG. 2, the ink ribbon includes sublimation dyes of yellow (Y) 101, magenta (M) 102, and cyan (C) 103 and markers 104 and 105 arranged between each color for detecting the top position of each color. Positioning of the top position for each color is performed by detecting the marker by an ink ribbon marker detection sensor such as a photo reflector while conveying the ink ribbon before printing each color.

The top marker 104 of the first color is differentiated from the other markers 105 by the number of the marker lines to be able to perform positioning of the top position for the first color no matter where the ink ribbon is located. When performing positioning of the top position for the first color using such an ink ribbon, the ink ribbon may be wasted by skipping.

SUMMARY OF THE INVENTION

According to an aspect of the present invention, a printer that performs printing by transferring ink of an ink ribbon on which a plurality of color inks is sequentially arranged to paper, includes a paper conveyance unit configured to convey paper, an ink ribbon conveyance unit configured to be driven by the same drive source as that of the paper conveyance unit and convey the ink ribbon only in a printing direction, and a detection unit configured to detect a marker for detecting the top of color inks provided on the ink ribbon, wherein a marker of a specific color ink of the ink ribbon includes marker pieces, the number of which is greater than that of the other markers.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 6:
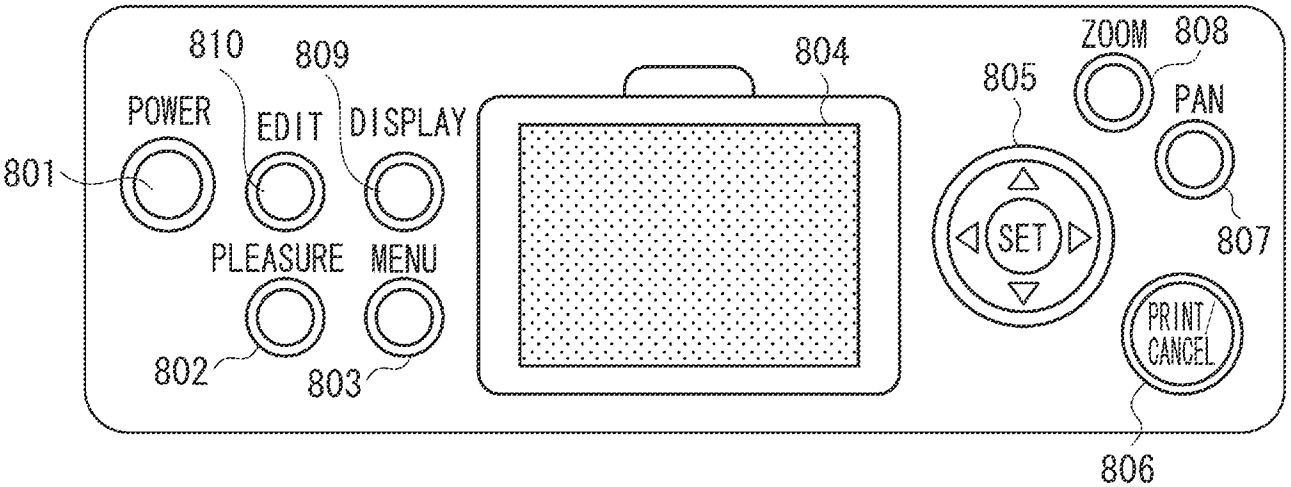
FIG. 6 is an external view of an operation unit of the thermal transfer printer according to the exemplary embodiment of the present invention.

FIG. 6 is a diagram illustrating an external view of an operation unit of the thermal transfer printer according to the exemplary embodiment of the present invention. The operation unit is provided with a power button 801 for turning on/off the printer, a print/cancel button 806 for instructing execution/cancellation of printing, and a liquid crystal screen 804 for displaying a Graphical User Interface (GUI) screen. When the power button 801 is pressed and the power is turned on, image data stored in a memory card is read and the image is displayed on the liquid crystal screen 804. In this state, a user selects an image to be printed and performs print setting by arrow keys/SET button 805. Also, the user can press an edit button 810 to move the screen to a trimming edit screen of the image data or press a zoom button 808 or a pan button 807 to determine the trimming size of the image. Also, the user can press the display button 809 to display information such as the file name and the size of the selected image data. Further, the user can press a pleasure button 802 to move the screen to a selection screen of edit functions such as calendar creation and multiple layout creation (laying out a plurality of images). After the selection of the image to be printed and the various print settings are completed, when the print/cancel button 806 is pressed, print processing of the thermal transfer printer is started.

Figure 5:
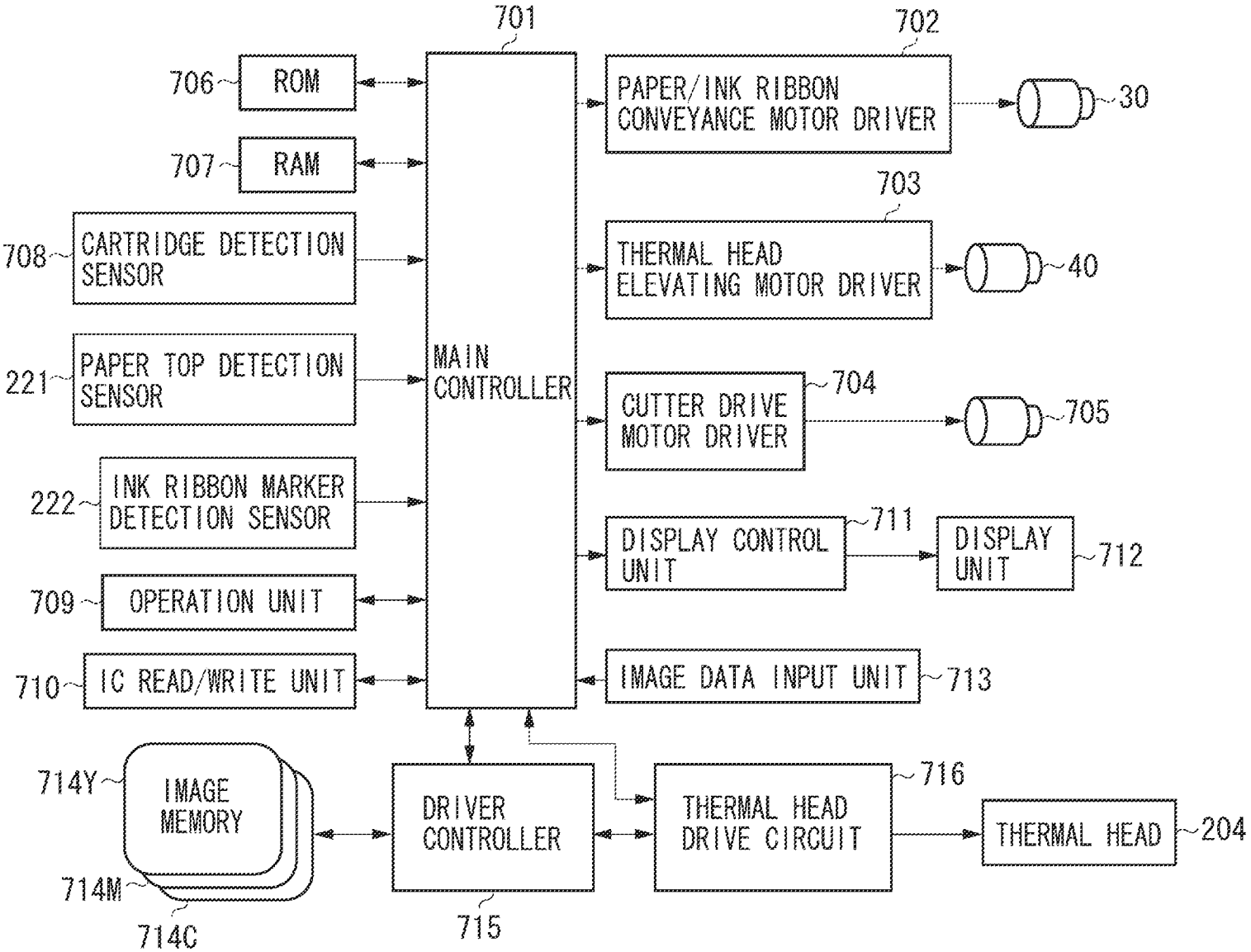
FIG. 5 is a block diagram illustrating a functional configuration of the thermal transfer printer according to the exemplary embodiment of the present invention.

FIG. 5 is a block diagram illustrating a functional configuration of the thermal transfer printer according to the present exemplary embodiment. The main controller 701 controls the entire thermal transfer printer. The main controller 701 reads a control program stored in a read-only memory (ROM) 706 and performs control of the printer according to the read control program and calculation processing according to various programs. The main controller 701 also performs processing such as processing the image data to generate image data necessary for printing and storing the image data into a random access memory (RAM) 707. The RAM 707 is also used as a work area for various control programs such as control programs for temporary storage of image data and image resizing processing. The ROM 706 stores a system control program and various parameters such as adjustment values.

Figure 2:
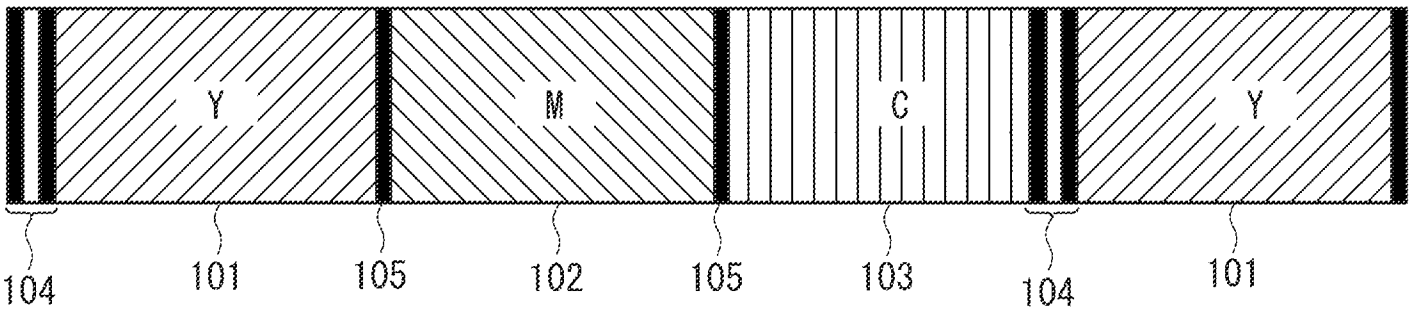
FIG. 2 is a diagram for explaining markers of the ink ribbon of the thermal transfer printer according to the exemplary embodiment of the present invention.

A stepping motor driver 702 (paper/ink ribbon conveyance motor driver) drives a stepping motor 30. The main controller 701 transmits an instruction for controlling the number of paper conveyance steps and an instruction for controlling the conveyance direction to the stepping motor driver 702 according to the control program stored in the ROM 706. The stepping motor 30 is connected to a roll paper roller shaft 200, a grip roller 202, a paper discharge roller 212 described below via a rotation mechanism, and conveys paper by driving these rollers. The stepping motor 30 also drives a roll bobbin 219 for winding up the ink ribbon via the rotation mechanism to wind up the ink ribbon 600. Here, in the present exemplary embodiment, an ink ribbon as illustrated in FIG. 2 is used. On the ink ribbon, a plurality of color inks (Y, M, and C) is frame-sequentially arranged, and a marker for indicating the top of the color ink is disposed at the top of each color ink.

A thermal head elevating motor driver 703 controls rotation of a thermal head elevating motor 40 for elevating a thermal head 204 to operate the thermal head 204 between a printing position and a retracting position.

A cutter drive motor driver 704 controls a cutter motor 705 for driving a cutter unit 207 to cut paper.

A paper top detection sensor 221 is disposed between a platen roller 205 provided to face the thermal head 204 and a grip roller 202. The top detection sensor 221 detects that the top edge of paper pulled out from a cartridge when the printing is started passes through a point behind the grip roller 202.

A marker detection sensor 222 of the ink ribbon 600 detects the marker coated along the top edge of each color of the ink ribbon 600.

A cartridge detection sensor 708 determines a loading state of the cartridge and the type of the cartridge from among a plurality of cartridges. Based on the determination result, print processing according to the cartridge is performed according to the control program stored in the ROM 706.

When the print/cancel button 806 is pressed and print processing is started, the processing described below is performed by the control of the main controller. First, paper is fed from the cartridge to the print start position. Next, while the paper is being pulled into the cartridge, the ink ribbon is conveyed and a yellow image of the ink ribbon is thermally transferred to the paper by the thermal head. Next, the paper is returned to the print start position. Thereafter, a magenta image is thermally transferred so that the magenta image is superimposed on the position of printed yellow image. Then the paper is returned to the print start position again and a cyan image is thermally transferred in the same manner as above. In this way, by superimposing three images together, one image is formed. When one photo is printed, the paper reciprocates a plurality of times in the printer. In this case, if the print start positions of each color or the paper conveyance amounts of each color are different from each other, the print positions of yellow, magenta, and cyan are shifted from each other, so the print quality degrades. Therefore, in the paper conveyance operation by the grip roller 202, the number of paper conveyance steps is managed by the main controller 701 and the stepping motor driver 702. After the top edge of the paper is detected by the paper top detection sensor 221, the paper is conveyed by a step control, so that paper conveyance with a high degree of accuracy is performed. A plurality of protrusions is formed on the surface of the grip roller 202 at a predetermined interval. The paper is pressed to a pinch roller by the protrusions of the grip roller with strong force and the paper is nipped. The nip state is maintained until the print is completed.

The ink ribbon is conveyed by rotating a wind-up bobbin. The drive source for conveying the ink ribbon is the same as that for conveying the paper to reduce the cost. Before printing an image by each color ink, the marker for positioning of the top position for the ink ribbon is detected while the ink ribbon is being conveyed, and print of the image is started from the position where the marker is detected.

Figure 3:
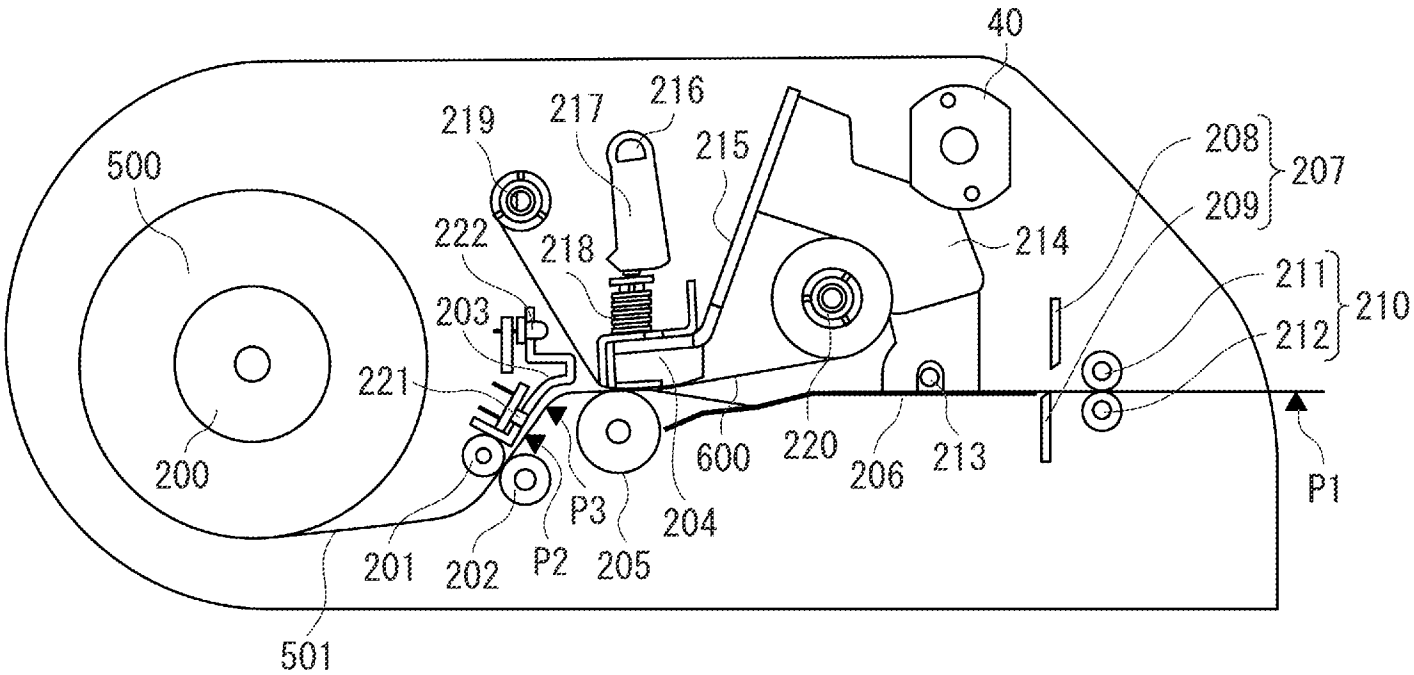
FIG. 3 is a side cross-sectional view illustrating a configuration and returning points of the thermal transfer printer according to the exemplary embodiment of the present invention.

FIG. 3 is a cross-sectional view of a printer engine. Configurations of each unit that operates when the print processing is performed will be briefly described with reference to FIG. 3. In FIG. 3, the conveyance path 501 is a path through which a roll paper 500 contained in a cartridge passes when the roll paper 500 is pulled out to a paper discharge position.

A pressing force to the grip roller 202 is applied toward the pinch roller 201 by an elastic member not illustrated in FIG. 3 and the roll paper 500 is nipped between the pinch roller 201 and the grip roller 202.

The decurl guide 203 is provided along with a decurl unit not illustrated in FIG. 3 to provide a curvature opposite to that of the curl of the roll paper when print is performed, and the decurl guide 203 and the decurl unit correct the paper curl of the roll paper 500.

The platen roller 205 maintains a state in which the ink ribbon 600 and the roll paper 500 are overlapped with each other between the platen roller 205 and the thermal head 204 at the printing position. On the other hand, when print is not performed, the thermal head 204 is moved to the retracting position. A force applied to the thermal head will be described below.

The roll paper 500 reciprocates on a paper guide 206.

A cutter unit 207 includes a movable blade 208 and a fixed blade 209 disposed to face the movable blade 208. When the movable blade 208 is moved downward in the vertical direction in FIG. 3 by a drive source not illustrated in FIG. 3, the upper blade and the lower blade rub together, so that the roll paper 500 is cut.

The paper discharge roller unit 210 conveys the cut roll paper 500 in a paper discharge direction. The paper discharge roller unit 210 includes a paper discharge roller 212 and a driven roller 211 that are disposed opposite to each other across the roll paper 500.

Figure 4A:
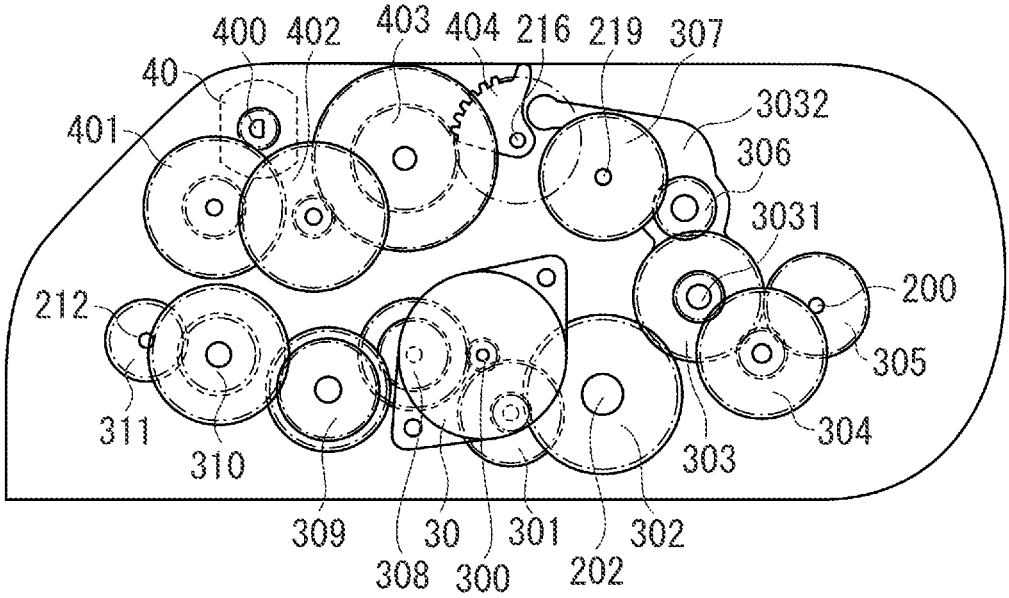
FIGS. 4A and 4B are side views illustrating a configuration of a drive mechanism of the thermal transfer printer according to the exemplary embodiment of the present invention.
Figure 4B:
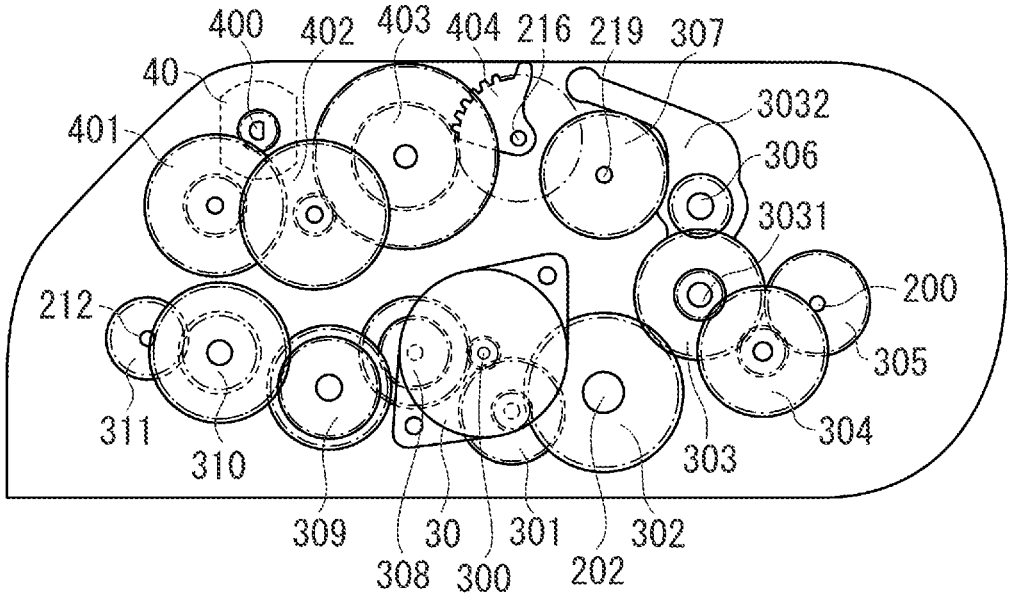

Next, a drive system of the present exemplary embodiment will be described with reference to FIGS. 4A and 4B. FIGS. 4A and 4B are side views illustrating a configuration of the drive mechanism of the printer device. FIG. 4A illustrates the drive mechanism when conveying paper in the printing direction. FIG. 4B illustrates the drive mechanism when conveying paper in the direction opposite to the printing direction. First, a case in which the paper is conveyed in the printing direction will be described. When driving in the printing direction, the pinion 300 is rotated by rotation of the stepping motor 30. A gear 305 rotates by the rotation of the pinion 300 via gears 301 to 304, and the roll paper roller shaft 200 rotates with the gear 305. A planet gear 306 is mounted on a bracket 3032. The bracket 3032 rotates around the shaft 3031 according to the rotation of a gear 303. By the rotation of the bracket 3032, the planet gear 306 rotates and moves to a position to engage with the gear 307. Therefore, as illustrated in FIG. 4A, when the paper conveyance motor 30 rotates in the clockwise direction in FIG. 4A, in other words, rotates in the printing direction, the planet gear 306 engages with the gear 307, the ink ribbon wind-up shaft 219 rotates with the gear 307, and the ink ribbon 600 is wound up. The gear 311 rotates by the rotation of the pinion 300 via gears 308 to 310, and the paper discharge roller 212 rotates with the gear 311. In summary, when the stepping motor 30 is driven to be rotated in the direction in which the paper is conveyed in the printing direction, the driving force is transmitted to the grip roller 202, the roll bobbin 219 for winding up the ink ribbon, and the paper discharge roller 212, and the grip roller 202, the roll bobbin 219 for winding up the ink ribbon, and the paper discharge roller 212 rotate together in the printing direction.

A case in which the paper is conveyed in the direction opposite to the printing direction will be described. The pinion 300 is rotated by the rotation of the stepping motor 30. The gear 305 rotates by the rotation of the pinion 300 via the gears 301 to 304, and the roll paper roller shaft 200 rotates with the gear 305. The bracket 3032 rotates around the shaft 3031 according to the rotation of the gear 303, and the planet gear 306 rotates and moves to a position to be separated from the gear 307. Therefore, when driving in the direction opposite to the printing direction, the roll bobbin 219 for winding up the ink ribbon does not rotate and the ink ribbon is not conveyed.

By rotation of the thermal head pressure switching motor 40, the gear 400 mounted on the shaft of the motor 40 rotates. A sector gear 404 rotates by the rotation of the gear 400 via the gears 401 to 403, and the rotation shaft 216 rotates with the sector gear 404. The thermal head pressure applied to the thermal head 204 will be described with reference to FIG. 3. The thermal head pressure lever 217 is attached to the rotation shaft 216 rotated by the rotation of the sector gear 404, and the thermal head pressure lever 217 rotates according to the rotation or the rotation shaft 216. By the rotation of the thermal head pressure lever 217, a thermal head pressure spring 218 is expanded or contracted. When printing is performed, as illustrated in FIG. 3, a pressure force is applied to the thermal head 204 by the elastic force of the thermal head pressure spring 218.

On the other hand, when printing is not performed, the thermal head pressure lever 217 rotates in the counterclockwise direction around the rotation shaft 216 from the state illustrated in FIG. 3. An elastic body (not illustrated) is attached to either the thermal head support plate 215 that supports the thermal head 204 or the bracket 214 to which the thermal head support plate 215 is coupled, between the thermal head support plate 215 or the bracket 214 and the base frame. An elastic force is biased in a direction in which the thermal head 204 is retracted from the platen roller 205 by the elastic body. When the pressure is not applied by the thermal head pressure lever 217, the bracket 214 rotates around the rotation center 213 in the clockwise direction by the elastic force, and thereby the thermal head 204 is moved to the retracting position.

As described above, in the thermal transfer printer of the present exemplary embodiment, when the paper is conveyed in the printing direction, the ink ribbon is also conveyed, and when the paper is conveyed in the direction opposite to the printing direction, the ink ribbon is not conveyed and only the paper is conveyed.

Hereinafter, the printing operation will be described with reference to FIG. 3. In the present exemplary embodiment, an example will be described in which the length in the sub-scanning direction is 150 mm, which indicates KG size. First, the roll paper roller shaft 200, which rotates integrally with the roll paper 500, rotates in the counterclockwise direction, and the roll paper 500 rotates. When the roll paper 500 rotates, the roll paper 500 is fed from the cartridge and conveyed to the grip roller 202. The roll paper 500 nipped between the pinch roller 203 and the grip roller 202 is further conveyed by the grip roller 202 rotating in the clockwise direction in FIG. 3, and passed through a gap between the thermal head 204, which is moved to the retracting position, and the platen roller 205.

The paper top detection sensor 221 is disposed on the downstream side of the grip roller 202. When the top edge of the roll paper 500 passes the paper top detection sensor 221, the output of the paper top detection sensor 221 is switched from OFF to ON. After the top edge of the roll paper 500 is detected, the position control of the conveyed roll paper 500 is performed by open loop control. In the thermal transfer printer according to the present exemplary embodiment, conveyance of 0.0866 mm of the roll paper 500 is realized by three steps of a pulse signal that drives the motor.

By driving the stepping motor 30 for additional 6500 steps when the output of the paper top detection sensor 221 turns ON, the roll paper 500 is conveyed to the print start position P1, and then the rotation of the stepping motor 30 is stopped. When the roll paper 500 reaches the print start position, positioning of the top position for the top marker 104 of the ink ribbon 600 is performed. After the positioning of the ink ribbon 600 is completed, the roll paper 500 is conveyed to the print start position again. The method for the positioning of the top position for the top marker 104 of the ink ribbon 600 will be described below.

When the positioning of the top marker 104 of the ink ribbon 600 is completed, the thermal head pressure switching motor 40 is driven, the bracket 214 is rotated, and the thermal head 204 integrally fixed to the bracket 214 is moved to the printing position. After the thermal head 204 is moved to the printing position, in a period of 5196 steps in which the roll paper 500 is conveyed from the print start position to the print end position, the thermal head 204 is energized. While the roll paper 500 is being conveyed, the ink ribbon wind-up shaft 219 rotates and the yellow ink ribbon 101 is pulled out from the ink ribbon supply shaft 220 while the superimposition state between the yellow ink ribbon 101 and the roll paper 500 is maintained, and thereby yellow printing on the roll paper 500 is performed.

When the yellow printing on the roll paper 500 is completed, the thermal head pressure switching motor 40 is driven, the bracket 214 is rotated, and the thermal head 204 integrally fixed to the bracket 214 is moved to a predetermined retracting position. After the thermal head 204 has been moved to the predetermined retracting position, the roll paper 500 is returned to a stand-by position by driving the grip roller 202 for 5196 steps in the clockwise direction in FIG. 3.

In this way, the yellow printing on the roll paper 500 is performed and the roll paper 500 is returned. Thereafter, the same operation is performed in the order of magenta and cyan.

When the cyan printing is completed, the thermal head pressure switching motor 40 is driven, the bracket 214 is rotated, and the thermal head 204 integrally fixed to the bracket 214 is moved to the predetermined retracting position. After the thermal head 204 has been moved to the predetermined retracting position, the roll paper 500 is conveyed in the paper discharge direction. In this case, the roll paper 500 is conveyed so that the boundary between the printed area and the non-printed area is located at a cutting-off position of the cutter unit 207. After the roll paper 500 is driven for 7500 steps by the grip roller 202, the roll paper 500 is cut off by the cutter unit 207.

The printed roll paper 500 that has been cut off by the cut processing is gripped by the paper discharge roller 212. From this state, the paper discharge roller 212 rotates for 700 steps in the clockwise direction in FIG. 3, and the printed roll paper 500 is discharged to the outside of the printer. After the discharge operation of the printed paper is completed, the remaining roll paper 500 is in a state of being pulled out. If the next print operation is not performed, winding-up operation of the roll paper is performed to enable the cartridge to be detachable. The winding-up operation of the roll paper is performed by rotating the grip roller 202 in the counterclockwise direction in FIG. 3 and rotating the roll paper roller shaft 200 in the clockwise direction in FIG. 3. When the roll paper is wound up, the paper top detection sensor 221 used in the paper top positioning operation is used. While the roll paper 500 is wound up, the output of the paper top detection sensor 221 is switched from ON to OFF. The roll paper 500 is pulled into the cartridge by additionally driving the grip roller 202 and the roll paper roller shaft 200 for 3000 steps using the OFF signal of the paper top detection sensor 221 as a trigger.

In this way, one print image is formed.

Figure 9:
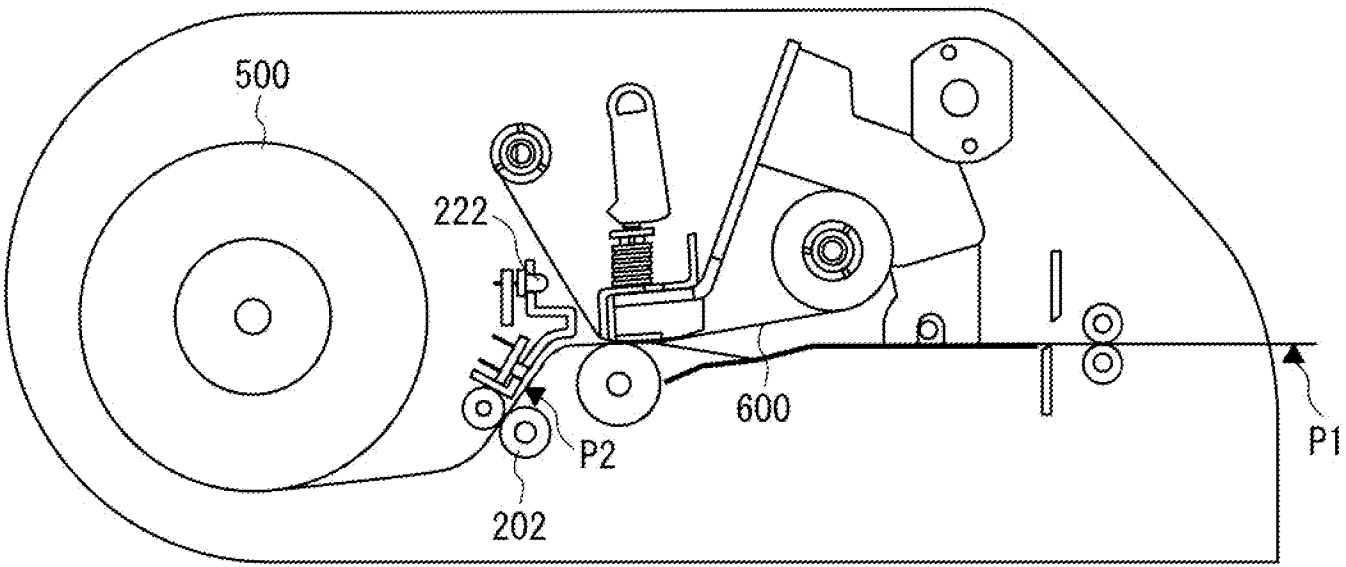
FIG. 9 is a side cross-sectional view illustrating a returning point of a thermal transfer printer.
Figure 10A:
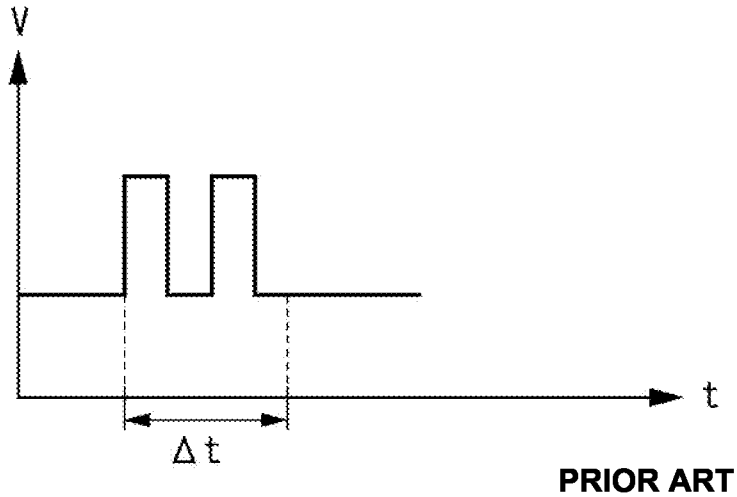
FIGS. 10A and 10B are diagrams illustrating an output of an ink ribbon marker sensor when detecting a top marker.
Figure 10B:
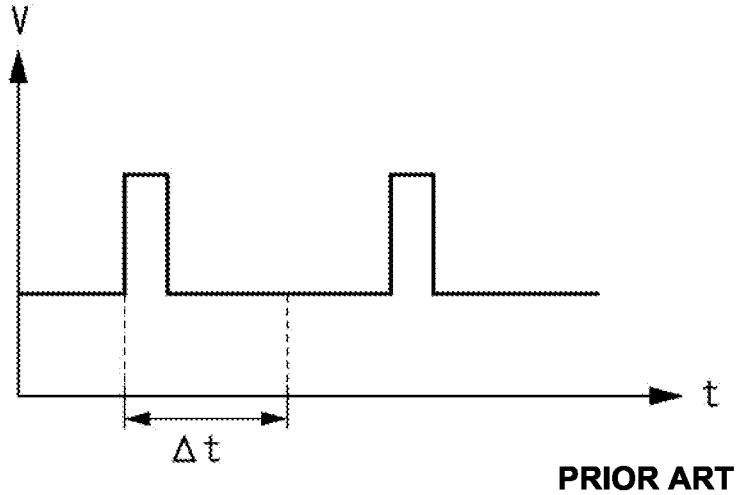

Here, a general method for detecting the top marker will be described with reference to FIGS. 9, 10A, and 10B. FIG. 9 is a side cross-sectional view illustrating a configuration and a returning point of an ordinary thermal transfer printer. FIGS. 10A and 10B illustrate a detection example of the marker 104 of the first color by an ink ribbon marker detection sensor. FIG. 10A illustrates a case in which two markers 104 of the first color is successfully detected. FIG. 10B illustrates a case in which the markers 104 of the first color are failed to be detected.

As illustrated in FIGS. 10A and 10B, the output of the ink ribbon marker detection sensor 222 rises only when the sensor detects the marker, so that the number of the markers is determined by the number of times the output rises. The marker 104 of the first color includes two markers which are arranged in a short interval. Therefore, as illustrated in FIG. 10A, the marker of the first color is determined by detecting two markers within a predetermined time period (steps) Δt by the ink ribbon marker detection sensor 222.

In the present exemplary embodiment, the drive source for conveying the ink ribbon and the drive source for conveying the paper are integrated together. In this case, when positioning the ink ribbon 600, the paper 500 is also conveyed. Therefore, the ink ribbon is conveyed along with the paper in the printing direction, and the ink ribbon is positioned by conveying the paper and the ink ribbon to a predetermined position (for example, to a position just before the paper disengages from the grip roller).

If the marker cannot be detected even when the ink ribbon 600 is conveyed to the predetermined position, the motor is once stopped, and then the motor is rotated in the opposite direction to convey the ink ribbon in the opposite direction. Thereafter, the paper and the ink ribbon are conveyed again in the printing direction. It is necessary to repeat such conveyance processing in the printing direction and the opposite direction until the positioning of the ink ribbon is completed.

The position just before the paper disengages from the grip roller, which is the position of the top edge of the paper when the motor is once stopped and rotated in the opposite direction is assumed to be a returning point P2. In this case, if one marker is detected just before the returning, and thereafter, the ink ribbon is conveyed in the opposite direction, and if the other marker is detected just after the ink ribbon is conveyed again in the printing direction, two markers are continuously detected. Therefore, the marker 104 of the first color is detected.

However, in this case, as illustrated in FIG. 10B, the time interval between the detections of the two markers is increased by time of the returning operation. Therefore, the condition that the two markers are detected within a predetermined time period (steps) Δt is not satisfied, so that there is a problem that the top marker 104 is not recognized as the top marker and the marker is skipped. If the top marker 104 is skipped, there is a problem that the ink ribbon for one page is wasted.

It is possible to determine by control of the main controller that the markers are the top marker in the case where the fact that one marker is detected near the returning point is stored, and if the other marker is detected just after the conveyance of the ink ribbon is started again. However, in this case, the system becomes complicated. In addition, there may be a case in which, when the paper is conveyed in the opposite direction, the ink ribbon is slightly conveyed in the opposite direction by being pulled by the paper and the same marker is detected twice.

Figure 1:
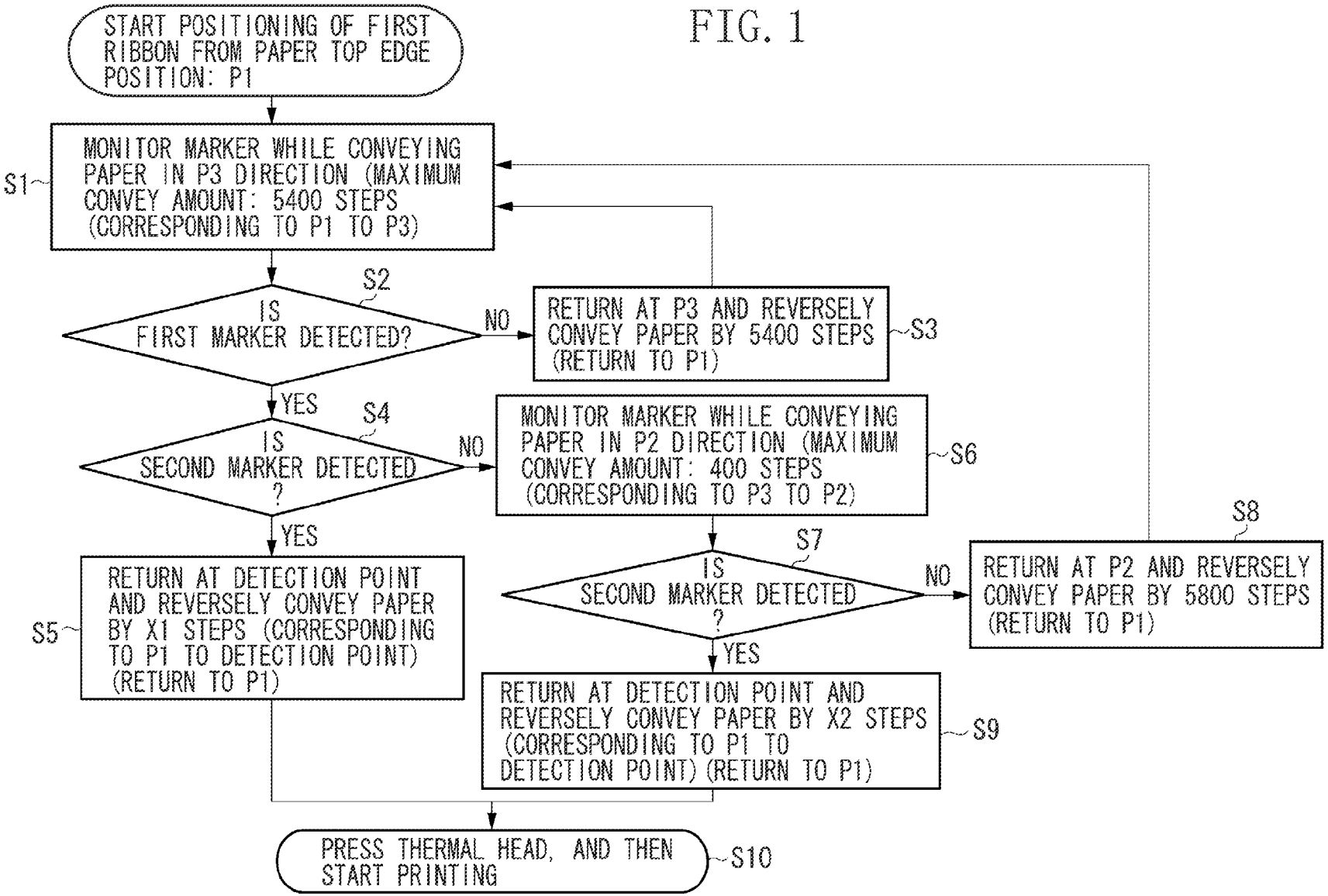
FIG. 1 is a flowchart illustrating a positioning of the top position operation for a top position of a top marker of an ink ribbon of a thermal transfer printer according to an exemplary embodiment of the present invention.

To prevent the top marker from being skipped, in the present exemplary embodiment, the Y ink which is the first color is detected as described below. Hereinafter, the top marker detection method of Y ink according to the exemplary embodiment of the present invention will be described with reference to FIGS. 1, 3, and 7. FIG. 1 is a flowchart illustrating the top marker detection method of the present invention. The top marker detection processing of Y ink is processing for conveying the ink ribbon to the Y ink which is printed first when the print processing is started. P3 in FIG. 3 indicates a second returning point, which is set between the print start point P1 and the first returning point P2. When the top edge of the paper is conveyed to the first returning point P2 or the second returning point P3, the paper is conveyed in the direction opposite to the printing direction and reversely conveyed to the print start position P1.

Figure 7:
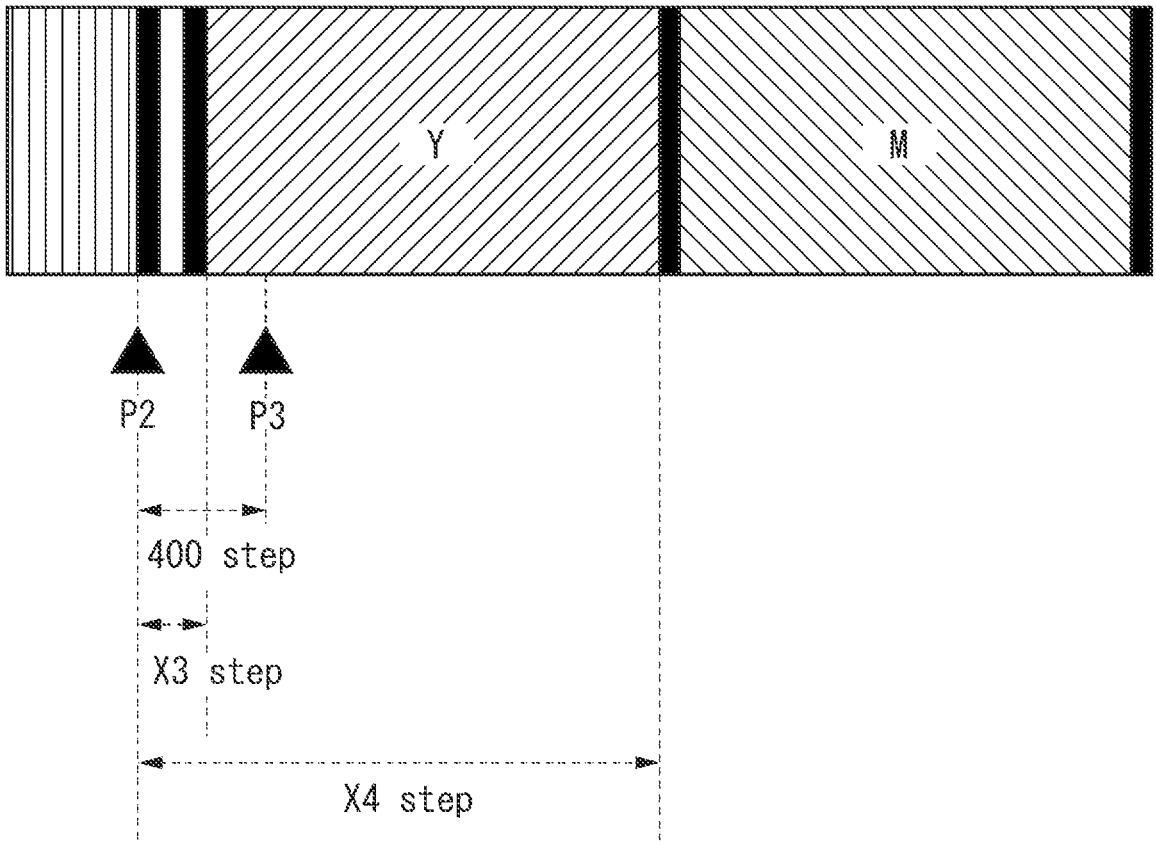
FIG. 7 is a diagram illustrating a relationship between the returning points and the length of the ink ribbon of the thermal transfer printer according to the exemplary embodiment of the present invention.

The distance between the first returning point P2 the second returning point P3 will be described with reference to FIG. 7. The second returning point P3 is usually a point at which, when the top edge of the paper comes to this position, the conveyance of the paper and the ink ribbon in the printing direction is stopped and only the paper is reversely conveyed. P1, P2, and P3 are set so that, when the first piece of the top marker 104 is detected while the paper is conveyed from the print start position P1 to the second returning point P3, the second piece of the top marker 104 is detected if the paper is conveyed from the second returning point P3 to the first returning point P2. Specifically, as illustrated in FIG. 7, the distance between P2 and P3 is at least X3 steps which is the number of steps required to transfer the ink ribbon from the top edge to the back edge of the entire top marker 104. Further, the distance between P1 and P3 is smaller than a distance conveyed by X4 steps so as not to detect and recognize markers of colors other than the first color, for example, two markers of the marker 105 of M and the marker 105 of C as the top marker. Here, the X4 is the number of steps required to convey the ink ribbon between markers of each color. In summary, the distance from P1 to P3 is set to smaller than the distance between markers of each color, and the distance from P3 to P2 is set to larger than the distance from the top edge to the back edge of the entire top marker 104. In the present exemplary embodiment, the distance between P2 and P3 is set to 400 steps, which satisfies the above condition.

A flow of the top marker detection method according to the present exemplary embodiment using the second returning point P3 will be described with reference to FIG. 1. The processing in FIG. 1 is performed by the main controller controlling each block based on the control program. First, in step S1, the stepping motor 30 is rotated in the clockwise direction, and thereby, while the ink ribbon 600 is wound up, the top marker 104 of the ink ribbon 600 is detected by the ink ribbon marker detection sensor 222. The roll paper 500 whose top edge is stopped at the print start position P1 when the marker detection operation is started is conveyed along with the ink ribbon 600 in the roll paper winding-up direction. In step S1, while the roll paper 500 and the ink ribbon 600 are conveyed in the direction toward the second returning point P3, the detection operation of the top marker 104 is performed by the ink ribbon marker detection sensor 222.

In this case, 5400 steps, which is the distance between the print start position P1 and the second returning point P3, is set as the maximum conveyance amount. In step S2, the paper conveyance operation is started from the print start position P1, and it is determined whether one marker is detected within the 5400 steps. If no marker is detected (No in step S2), the processing proceeds to step S3.

In step S3, the conveyance of the roll paper 500 is stopped at the position where the top edge of the paper corresponds to the second returning point P3, and at the same time, the conveyance of the ink ribbon 600 is stopped. To return the top edge of the roll paper 500 to the print start position P1, the stepping motor is reversely rotated by 5400 steps. When the top edge of the roll paper 500 is returned to the print start position P1, the stepping motor is stopped and the marker detection operation in step S1 is performed again.

On the other hand, if one marker is detected in step S2 (Yes in step S2), the processing proceeds from step S2 to step S4. In step S4, it is determined whether the second marker is detected during the paper conveyance operation of 5400 steps to the second returning point P3. Here, if it is determined that the second marker is detected (Yes in step S4), the top marker is determined to be detected, the paper conveyance operation to the second returning point P3 is cancelled, and the processing proceeds to step S5. In this case, the top marker is successfully detected. Therefore, in step S5, the paper is conveyed in the opposite direction by X1 steps that is the number of paper conveyance steps from the print start position P1 to the detection position, and the paper conveyance operation to the print start position P1 is performed. Thereafter, the processing proceeds to step S10.

On the other hand, in step S4, if the second marker is not detected during the paper conveyance operation of 5400 steps to the second returning point P3, it is determined that the top marker is not detected (No in step S4), and the processing proceeds to step S6. In step S6, the roll paper 500 and the ink ribbon 600 are additionally conveyed in the direction toward the first returning point P2. In this case, 400 steps, which is the distance between the second returning point P3 and the first returning point P2, is set as the maximum conveyance amount.

In step S7, it is determined whether the second marker is detected during the paper conveyance operation of 400 steps from the second returning point P3 to the first returning point P2. If the second marker is not detected (No in step S7), the processing proceeds to step S8.

In step S8, the conveyance of the roll paper 500 is stopped at the first returning point P2, and at the same time, the conveyance of the ink ribbon 600 is stopped. Thereafter, to return the top edge of the roll paper 500 to the print start position P1, the stepping motor is reversely rotated by 5800 steps. When the top edge of the roll paper 500 is returned to the print start position P1, the stepping motor is stopped and the marker detection operation in step S1 is performed again. In this case, the marker detection operation is started in a state in which information that one marker is detected in step S2 is deleted.

On the other hand, in step S7, if the second marker is detected during the paper conveyance operation of 400 steps from the second returning point P3 to the first returning point P2 (Yes in step S7), the paper conveyance operation to the first returning point P2 is cancelled, and the processing proceeds to step S9. In this case, the top marker is successfully detected. Therefore, in step S9, the paper is conveyed in the opposite direction by X2 steps that is the number of paper conveyance steps from the print start position P1 to the detection position, and the paper conveyance operation to the print start position P1 is performed. Thereafter, the processing proceeds to step S10.

If the top marker is successfully detected in the manner as described above, in step S10, the thermal head is pressure-contacted to the platen roller, and printing of the first color is performed.

By the above processing, the positioning of the top position for the marker of the first color is completed. The positioning of the top position for the top marker is realized in a series of paper conveyance operations by the above method, so that the top marker can be prevented from being skipped. Further, the risk of failure of positioning the top marker due to temporary blackout can be reduced. In addition, it is possible to prevent the same marker from being detected twice when the ink ribbon is taken back along with the paper when the paper is reversely conveyed.

In the present exemplary embodiment, if the first marker is detected during the conveyance operation to the second returning point P3, the paper is conveyed to the first returning point P2. Here, if the second marker is not detected even when a predetermined period of time (steps) has elapsed since the first marker was detected, the detection information of the first marker may be deleted. Even when the first marker is detected during the conveyance operation to the second returning point P3, if the second marker is not detected within a predetermined period of time (steps), the first marker is determined not to be the top marker 104, the paper is not conveyed to P2 but returned, and the marker detection operation may be performed again.

Figure 8:
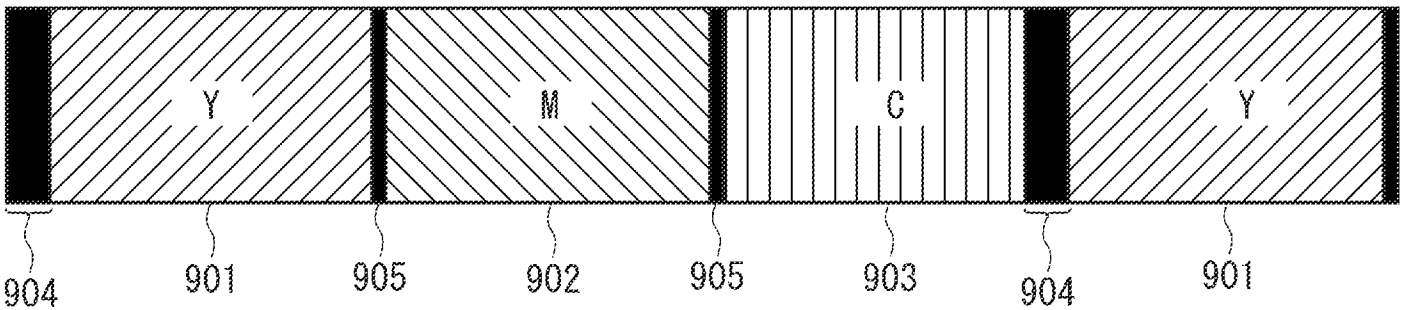
FIG. 8 is a diagram illustrating a configuration of the ink ribbon of the thermal transfer printer according the present invention.

Regarding the ink ribbon according to the present exemplary embodiment, as a method for differentiating the top marker from the other markers, a method for changing the number of the markers is described. However, the present invention is not necessarily limited to this method. Specifically, as illustrated in FIG. 8, the present invention is also effective when the lengths of the markers in the sub-scanning direction are different. In this case, a method is employed in which, when a marker area is continuously detected for a predetermined period of time (steps) or more, the marker area is detected as the top marker. It is possible to differentiate the top marker from the other markers in a similar manner to the present invention. Specifically, even when a marker is continuously detected during the conveyance operation to the second returning point P3, if the detection time period does not reach the predetermined period of time (steps), the marker detection operation is continuously performed during the conveyance operation to the first returning point P2, and if the marker area is continuously detected for the predetermined period of time (steps) or more, the marker area may be detected as the top marker.

Although, in the present exemplary embodiment, the detection operation of the top marker is described, the present invention is not limited to the top marker.

Although, in the present exemplary embodiment, the paper conveyance control between the print start position P1, the first returning point P2, and the second returning point P3 is performed by a stepping motor, it is possible to dispose paper detection sensors at each point and perform the paper conveyance control by the paper detection sensors.

Although the printer that uses continuous paper is described, the present invention is not necessarily limited to a printer that uses continuous paper. In other words, the same method can be applied to a printer that uses cut paper.

Although, in the present exemplary embodiment, the printer that uses continuous paper is described, the present invention is not necessarily limited to a printer that uses continuous paper. In other words, the same method can be applied to a printer that uses cut paper.

Although, in the present exemplary embodiment, the start position of the positioning of the top position and the print start position are the same position, these positions may be different positions. In this case, while positioning of the top position for the ink ribbon, the paper is reversely conveyed from the returning position to the start position of the positioning of the top position, and when the top marker 104 is detected, the paper is reversely conveyed to the print start position.

Although, in the present exemplary embodiment, the top marker 104 of the first color (Y) has two marker pieces and the markers of the other colors (M and C) have one marker piece, it is not limited to this, and Y may have three marker pieces, M may have two marker pieces, and C may have one marker piece. In this case, if two marker pieces are detected in the conveyance operation to P3, the paper is further conveyed to P2 and the top marker is detected. If two marker pieces are not detected in the conveyance operation to P3, the paper is reversely conveyed to P1, and then the positioning of the top position for the ink ribbon is performed by conveying the paper and the ink ribbon in the printing direction. If the third marker piece is detected in the conveyance operation to P2 or P3, the conveyance of the paper and the ink ribbon is stopped at the detection point and the paper is reversely conveyed to the print start position.

In other words, if the number of marker pieces corresponding to a specific color for the positioning is greater than the number of marker pieces of the other colors, the present exemplary embodiment can be applied.

As we described above, one aspect of the disclosures is directed to solving an issue that the ink ribbon is wasted when a marker of a specific color such as the top marker is skipped. While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-172290 filed Jul. 30, 2010, which is hereby incorporated by reference herein in its entirety.

What is claimed is:

1. A printer that performs printing by transferring ink of an ink ribbon to paper, wherein a plurality of color inks is sequentially arranged on the ink ribbon, the printer comprising:

a paper conveyance unit configured to convey paper;

an ink ribbon conveyance unit configured to be driven by a same drive source as that of the paper conveyance unit and convey the ink ribbon only in a printing direction;

a detection unit, configured to detect a marker, to detect the top of color inks provided on the ink ribbon; and a control unit configured to control the detection unit to perform marker detection processing for detecting a marker of the ink ribbon conveyed in the printing direction by the ink ribbon conveyance unit together with the paper while conveying the paper by the paper conveyance unit to a first position in the printing direction, and in a case where a marker is not detected during a period that the paper is conveyed to the first position in the marker detection processing, to cause the paper conveyance unit to convey only the paper in a direction opposite to the printing direction from the first position, and then to control the detection unit to perform the marker detection processing again, wherein a marker of a specific color ink of the ink ribbon includes a predetermined number of markers which is greater than that of other colors, and wherein, in a case where, when the printer performs detection of the specific color of the ink ribbon, markers the number of which is less than the predetermined number are detected during a period that the paper is conveyed to the first position, the control unit causes the paper conveyance unit to further convey the paper in the printing direction without conveying the paper in the direction opposite to the printing direction from the first position and controls the detection unit to detect a marker.

2. The printer according to claim 1, wherein the control unit determines that a marker of a specific color ink is detected in a case where a number of markers among the predetermined number of markers are detected during the period that the paper is conveyed to the first position and a remaining number of markers are detected in a period that the paper is further conveyed in the printing direction from the first position.

3. The printer according to claim 1, wherein the control unit controls the marker detection processing to be finished in a case where a number of markers among the predetermined number of markers are detected during the period that the paper is conveyed to the first position and a remaining number of markers are detected in a period that the paper is further conveyed in the printing direction from the first position.

4. The printer according to claim 3, further comprising a printing unit configured to print an image on the paper using ink of the ink ribbon, wherein the control unit controls the paper to be conveyed to a print start position in a direction opposite to the print direction in response to the detection of the remaining number of markers in the period that the paper is further conveyed in the printing direction from the first position, and wherein the print start position is a position at which the printing unit starts printing on the paper.

5. The printer according to claim 1, wherein, in a case where, when the printer detection unit performs detection of the specific color ink of the ink ribbon, markers the number of which is less than the predetermined number are detected during a period that the paper is conveyed to the first position, the control unit controls the paper conveyance unit to further convey the paper to a second position in the printing direction without conveying the paper in the direction opposite to the printing direction from the first position and controls the detection unit to detect a marker.

6. The printer according to claim 5, wherein the control unit controls the paper conveyance in the print direction to be stopped so that, after a number of markers have been detected from among the predetermined number of markers during the period that the paper is conveyed to the first position, a remaining number of markers among the predetermined number of markers are detected in a period that the paper is further conveyed in the printing direction from the second position.

7. The printer according to claim 6, further comprising a printing unit configured to print an image on the paper using ink of the ink ribbon, wherein the control unit stops conveyance of the paper in the print direction in a case where the predetermined number of markers are detected during a period that the paper is conveyed to the first position or the second position, and controls the paper to be conveyed, in the direction opposite to the print direction, to a print start position, and wherein the print start position is a position at which the printing unit starts printing on the paper.

8. The printer according to claim 6, wherein, in a case where a marker is not detected during the period that the paper is conveyed to the second position, the control unit causes the paper conveyance unit to convey only the paper in the direction opposite to the print direction from the first position and controls the marker detection processing to be performed again.

9. The printer according to claim 5, wherein the paper conveyance unit includes a pair of rollers for conveying the paper by nipping it therebetween, and wherein the paper is maintained in a nipped state by the pair of rollers at the first position and the second position.

10. The printer according to claim 5, wherein the paper conveyance unit includes a pair of rollers for conveying the paper by nipping it therebetween, and wherein the paper is maintained in a nipped state by the pair of rollers during a period that the marker detection processing is performed.

11. The printer according to claim 10, further comprising a printing unit configured to print an image on the paper using ink of the ink ribbon, wherein the paper is maintained in a nipped state by the pair of rollers until printing of an image by the printing unit is finished.

12. The printer according to claim 1, wherein the control unit controls the marker detection processing to be performed after conveying the paper to a predetermined position, and wherein a distance from the predetermined position to the first position is shorter than a distance between markers of the ink ribbon.

13. The printer according to claim 12, further comprising a printing unit configured to print an image on the paper using ink of the ink ribbon, wherein the control unit stops conveyance of the paper and the ink ribbon in response to detection of a marker of a specific color ink, and controls the paper to be conveyed, in the direction opposite to the print direction, to a print start position, wherein the print start position is a position at which the printing unit starts printing on the paper, and wherein the print start position and the predetermined position are the same position.

* * * * *